US006252827B1

(12) United States Patent
Geyer

(10) Patent No.: US 6,252,827 B1
(45) Date of Patent: Jun. 26, 2001

(54) DEVICE FOR REGULATING THE MINUTE HAND OF A CLOCK HAVING AT LEAST A MINUTE HAND AND A SECOND HAND

(75) Inventor: Helmut Geyer, Glashütte (DE)

(73) Assignee: Lange Uhren GmbH, Glashütte (DE)

( * ) Notice: Subject to any disclaimer, the term of this patent is extended or adjusted under 35 U.S.C. 154(b) by 0 days.

(21) Appl. No.: 09/147,880

(22) PCT Filed: Sep. 2, 1997

(86) PCT No.: PCT/EP97/04766

§ 371 Date: May 19, 1999

§ 102(e) Date: May 19, 1999

(87) PCT Pub. No.: WO98/12608

PCT Pub. Date: Mar. 26, 1998

(30) Foreign Application Priority Data

Sep. 18, 1996 (DE) ..... 196 38 013
Jun. 18, 1997 (DE) ..... 197 25 794

(51) Int. Cl.[7] ..... G04B 27/02
(52) U.S. Cl. ..... 368/190; 368/196
(58) Field of Search ..... 368/185, 187, 368/196–199

(56) References Cited

U.S. PATENT DOCUMENTS 3,526,088 * 9/1970 Meitinger ..... 368/161
3,762,153 * 10/1973 Komiyama et al. ..... 368/187
3,849,977 * 11/1974 Hirose et al. ..... 368/185

FOREIGN PATENT DOCUMENTS 249902 5/1948 (CH) .
284142 11/1952 (CH) .
442154 4/1967 (CH) .
632373 10/1982 (CH) .
2008291 5/1979 (GB) .

* cited by examiner

*Primary Examiner*—Vit Miska
(74) *Attorney, Agent, or Firm*—Martin A. Farber

(57) ABSTRACT

An arrangement for setting the minute hand of a timepiece which has at least minute and second hands 29, having a setting stem 1 which can be moved axially out of a normal position into a setting position. In this case, upon movement of the setting stem 1 out of the normal position into the setting position, a zero setting drive of the second hand 29 can be driven such that it moves the latter into its zero position and the seconds stem 28, which bears the second hand 29, can be driven via a seconds-display drive mechanism 30 of the movement mechanism of the timepiece. The seconds-display drive mechanism 30 has a blocking device which can be actuated, by virtue of the setting stem 1 being moved in the direction of the setting position, such that the seconds-display drive mechanism 30 is blocked before the second hand 29 is moved into the zero position.

20 Claims, 4 Drawing Sheets

DEVICE FOR REGULATING THE MINUTE HAND OF A CLOCK HAVING AT LEAST A MINUTE HAND AND A SECOND HAND

Arrangement for setting the minute hand of a timepiece which has at least minute and second hands

FIELD AND BACKGROUND OF THE INVENTION

The invention relates to an arrangement for setting the minute hand of a timepiece which has at least minute and second hands, having a setting stem which can be moved axially out of a normal position into a setting position, it being the case that, upon movement of the setting stem out of the normal position into the setting position, a zero setting drive of the second hand can be driven such that it moves the latter into its zero position and the seconds stem, which bears the second hand, can be driven via a seconds-display drive mechanism of the movement mechanism of the timepiece.

In the case of a known arrangement of this type, the zero setting drive is a heart-cam zero setting drive which, depending on the position of the heart cam, moves the second hand into the zero position in the clockwise direction or the counterclockwise direction. As a result of production tolerances, there is always play in the wheel train leading to the seconds-display drive mechanism, and this play has to be overcome upon a zero setting movement of the second hand in the counterclockwise direction. If the second hand is then driven again in normal operation, the play in the wheel train must first be overcome before the second hand is moved. This results in the starting of the second hand being delayed, and thus in the time display being incorrect by from one to two seconds.

SUMMARY OF THE INVENTION

The objective of the invention is thus to provide an arrangement of the type mentioned in the introduction which ensures that the second hand starts correctly following a setting operation.

This object is achieved according to the invention in that the seconds-display drive mechanism has a blocking device which can be actuated, by virtue of the setting stem being moved in the direction of the setting position, such that the seconds-display drive mechanism is blocked before the second hand is moved into the zero position.

This means that the seconds-display drive mechanism is blocked before the zero setting movement of the second hand, with the result that said drive mechanism always remains free of play in the normal drive direction and ensures that the second hand starts correctly following a setting operation.

The setting stem may serve exclusively for the zero setting of the second hand.

If the setting stem is a minute setting stem of the timepiece and the setting position is the minute setting position, in which, by virtue of rotation of the setting stem, the minute hand can be driven such that it can be moved manually, then the setting stem fulfils both the function of initiating operation of the zero setting drive and the function of actuating the minute setting. Movement of the setting stem into its minute setting position alone automatically brings about zero setting of the second hand. In order to be able to carry out zero setting of the second hand without the drive of the movement mechanism being affected thereby, the seconds stem may be coupled to the movement mechanism of the timepiece with a force fit. For this purpose, in a straightforward embodiment, there may be arranged between the seconds stem and a seconds-display drive mechanism of the movement mechanism a prestressed coupling spring which butts against at least either the seconds stem or the seconds-display drive mechanism with a friction fit.

A space-saving embodiment is achieved in that the seconds-display drive mechanism is mounted on the seconds stem in a freely rotatable manner, it being possible, without any great amount of installation space being required, for the coupling spring to be arranged axially between the seconds stem and seconds-display drive mechanism.

Both a straightforward construction of the coupling spring and concentric loading of the components on which the coupling spring acts are achieved if the coupling spring is a spring which has one or more radially directed spring arms, of which one spring-arm end is arranged on the seconds stem and the second spring-arm end is supported on the end side of the seconds-display drive mechanism, it being possible for the second spring-arm end to be supported on a radially directed, flange-like widened section of the gear wheel.

In a straightforward configuration, the blocking device may have a blocking lever which can be pivoted about a pivot spindle and which can act on a moveable drive part of the seconds-display mechanism with a force fit and/or form fit and/or friction fit.

Fulfilling a double function, and thus saving space, the moveable drive part may be the flange-like widened section of the seconds-display drive mechanism, of which the radially peripheral lateral surface can have the blocking lever acting on it.

The seconds-display drive mechanism is blocked particularly reliably in that the radially peripheral lateral surface has a radially peripheral approximately V-shaped groove into which the blocking lever, which can be pivoted about the pivot spindle parallel to the axis of rotation of the seconds-display drive mechanism, can be pivoted by way of an approximately V-shaped blocking region.

A reliably functioning construction of straightforward configuration is achieved if the zero setting drive is a cam-plate drive, of which the cam plate is arranged fixedly on the seconds stem, which bears the second hand, and, upon movement of the setting stem in the direction of the setting position, can be driven such that it can be moved into the zero position by a zero setting lever, for which purpose the cam-plate drive is preferably a heart-cam zero setting drive. If the cam plate can be arrested in the zero position by the zero setting lever, then these components serve not just for movement into the zero position, but also for keeping the second hand in the zero position.

Just a small amount of installation space is required if the zero setting lever is a lever which can be pivoted about a spindle parallel to the seconds stem and which acts on the radially peripheral lateral surface of the cam plate.

A straightforward and space-saving setting drive is achieved in that the zero setting drive has a pivot lever which can be pivoted, about a pivot spindle parallel to the seconds stem, between a normal position and a zero setting position, which is forced into its zero setting position by spring action and which can act on the zero setting lever such that it can be moved out of its normal position, in which it is spaced apart from the cam plate, against the cam plate.

If the blocking lever can be driven such that it can be pivoted by the pivot lever, then the pivot lever fulfils more than one function at the same time.

Blocking of the seconds-display drive mechanism before the second hand is moved into the zero position is achieved, in a straightforward construction, in that the pivot spindle of the blocking lever and the spindle of the zero setting lever are arranged axially with respect to one another, and the blocking engagement direction of the blocking lever and the zero setting direction of the zero setting lever are oriented in approximately the same way.

If the action of a blocking spring forces the blocking lever both in the blocking engagement direction and against the pivot lever, such that the latter is forced into the zero setting position, then the blocking lever, following its blocking engagement, can easily be released from the pivot lever and this can move on further in relation to the cam plate of the cam-plate drive. For this purpose, a straightforward construction consists in that the action of the blocking spring forces the blocking lever into abutment against a stop of the pivot lever or of the zero setting lever, it being the case that, when the blocking lever and pivot lever are respectively pivoted in the blocking engagement direction and the zero setting direction, the blocking lever reaches the blocking position before the zero setting lever reaches the zero setting position.

BRIEF DESCRIPTION OF THE DRAWINGS

An exemplary embodiment of the invention is described in more detail hereinbelow and is illustrated in the drawings, in which.

DETAILED DESCRIPTION OF THE PREFERRED EMBODIMENT

Figure 1:
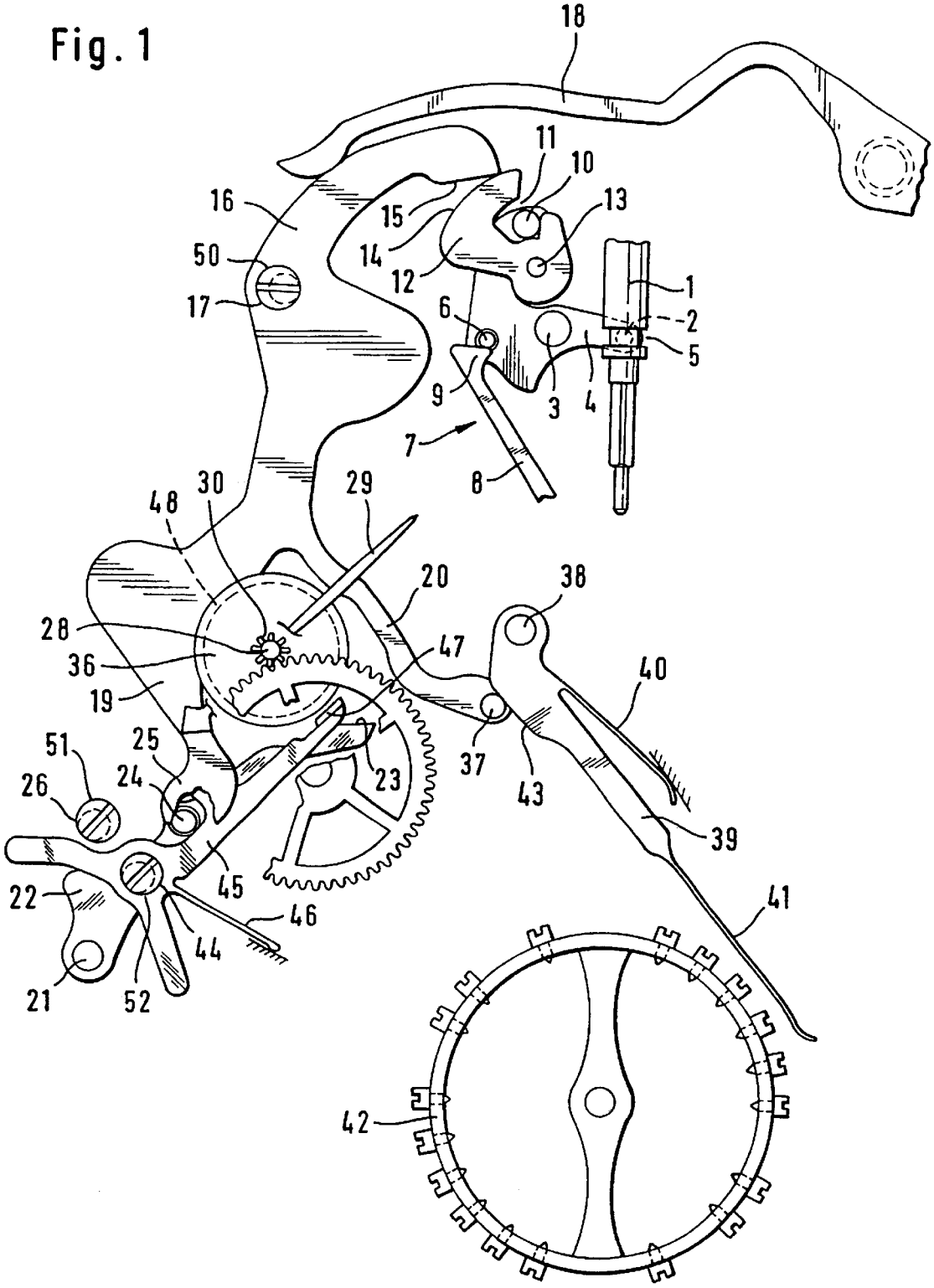
FIG. 1 shows the normal position of an arrangement for setting the minute hand of a timepiece which has a minute hand and second hand.
Figure 2:
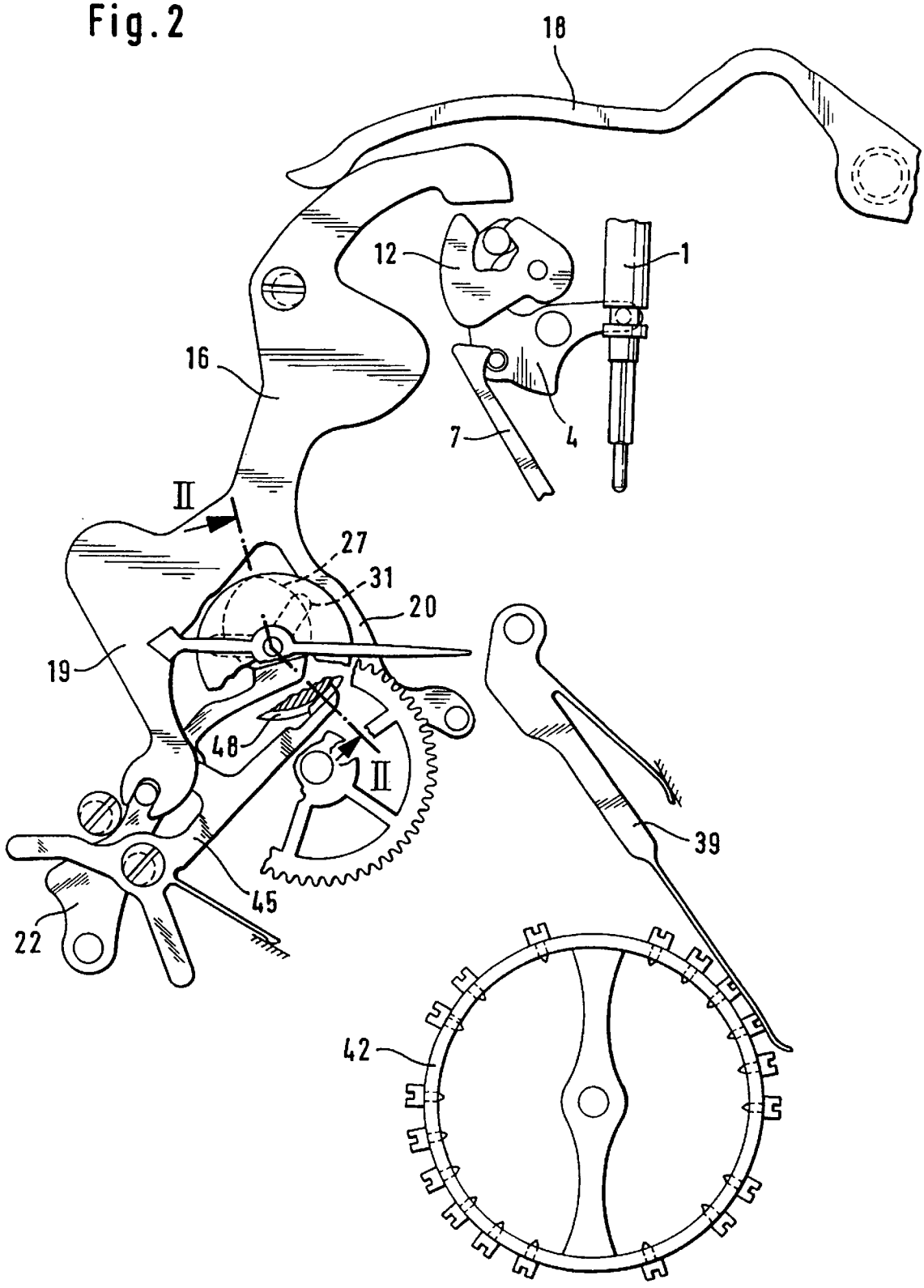
FIG. 2 shows the arrangement according to FIG. 1 in the setting position.

The arrangement illustrated has a setting stem 1 which can be displaced manually in the axial direction between a normal position (FIG. 1) and a setting position (FIG. 2).

The setting stem, in its setting position, is incorporated in a minute-hand drive (not illustrated) and, by virtue of the rotation of the setting stem 1 about its axis of rotation, can adjust the position of a minute hand (not illustrated either).

A pin 2 of an angle lever 4, which can be pivoted about a spindle 3, engages, transversely with respect to the axis of rotation of the setting stem 1, in an annular groove 5 formed around the periphery, in the radial direction, of the setting stem 1. By virtue of axial displacement of the setting stem 1, the angle lever 4 is pivoted about its spindle 3 via the pin 2.

A catch spring 7 acts on an extension 6, which projects from the angle lever 4, such that, depending on its pivot position , the angle lever 4 is forced into its rest position or its operation-initiating position or its hand setting position. The catch spring 7 comprises a spring arm 8 which is arranged in a fixed manner at one end and has a tooth 9 at its other end.

Figure 3:
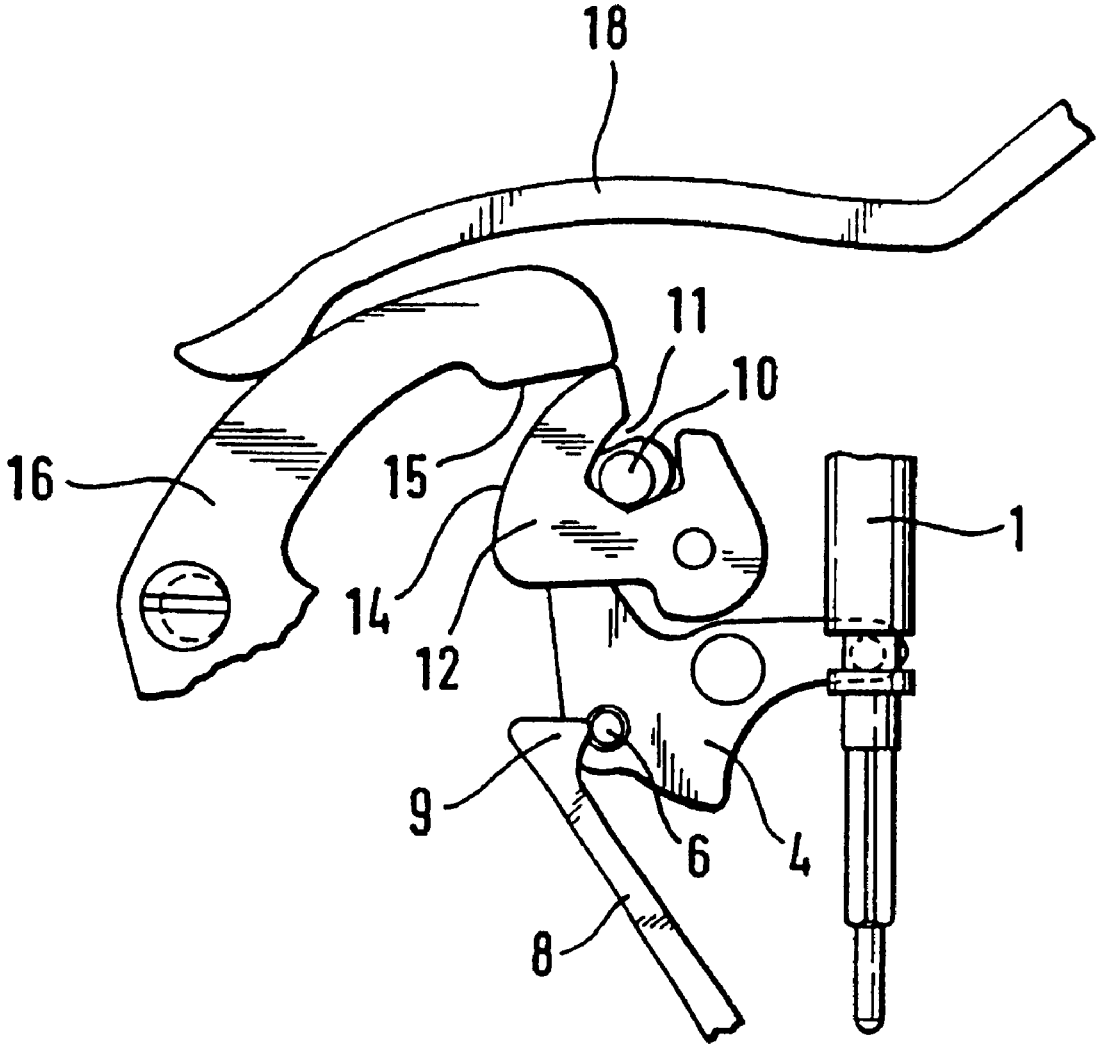
FIG. 3 shows a detail of the arrangement according to FIG. 1 in an intermediate position between the normal position and setting position.
Figure 4:
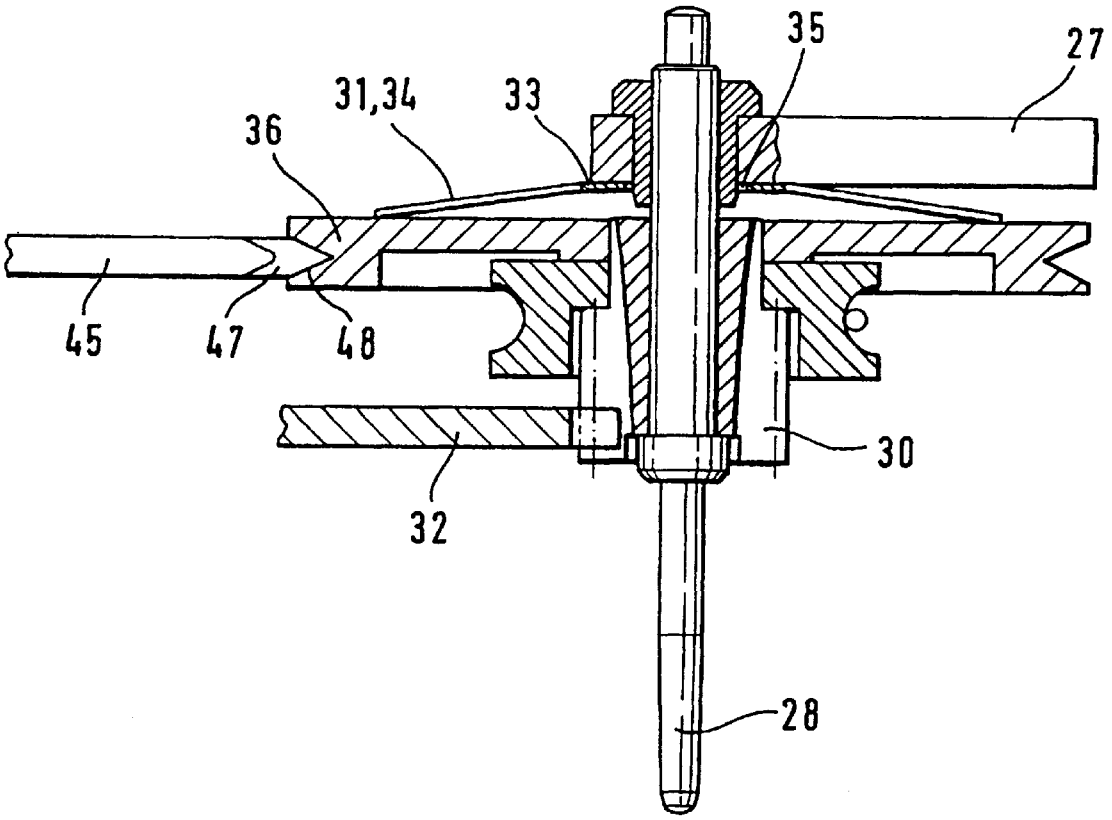
FIG. 4 shows a side view in the section along line II—II in FIG. 2.

In the rest position the tooth 9 abuts against the extension 6 by way of one flank, and in the operation-initiating position it butts against the same by way of its other flank. Upon pivoting of the angle lever 4, the spring arm 8 is deflected, with the result that the tooth 9 is moved beyond the extension 6 (FIG. 3).

On its lever arm opposite the setting stem 1, the angle lever 4 bears a stub 10 which engages in a groove 11 of a control plate 12.

The control plate 12 can be pivoted about a spindle 13 parallel to the spindle 3 of the angle lever 4, it being the case that the pivot path is limited by the ends of the groove 11, the stub 10 coming into abutment against said ends. In this case, the groove 11 is equidistant from the spindle 13.

The control plate 12 has a control curve 14 which is likewise equidistant from the spindle 13. This control curve 14, which is designed as an arc section, interacts with an activation surface 15 of a pivot lever 16 which can be pivoted about a pivot spindle 17 by the control curve 14.

For this purpose, the activation surface 15 is designed as a slope which is inclined with respect to a radial line to the pivot spindle 17 of the pivot lever 16. In this case the control curve 14 and activation surface 15 are inclined with respect to one another at such an angle that self-locking of the two parts sliding on one another is ruled out.

The pivot lever 16, by way of an activation surface 15, is forced permanently in the direction of the control curve 14 by the action of the free end of a prestressed spring arm 18 and, in the normal position (FIG. 1), rests on the control curve 14 in a prestressed manner by way of the activation surface 15.

However sliding of the control curve 14 along the activation surface 15, and thus pivoting of the pivot lever 16, is only possible when the angle lever 4 is pivoted by virtue of the setting stem 1 being moved out of the normal position into the setting position. In this case, the control curve 14, under the action of the force of the spring arm 18 on the pivot lever 16, slides along the activation surface 15 until, at the end of its pivot path, it is disengaged from the activation surface 15, since the ability of the pivot lever 16 to pivot is limited.

The pivot lever 16 is designed as a two-armed lever, on one lever arm of which the activation surface 15 is arranged. The other lever arm is branched into a zero setting arm 19 and a stopping arm 20. A zero setting lever 22 is arranged in a plane parallel to the zero setting arm 19, such that it can be pivoted about a spindle 21 parallel to the pivot spindle 17. In this case, the spindle 21 is located at one end of the zero setting lever 22, while arranged at the other end of the zero setting lever 22, directed in the pivot direction, is a setting surface 23.

Arranged approximately centrally between the setting surface 23 and spindle 21, on the zero setting lever 22, is a pin 24 which extends parallel to the spindle 21 and projects into the pivot region of the pivot lever 16. The pin 24 has a fork-shaped end 25 of the zero setting arm 19 engaging around it, and the pivot position of the zero setting lever 22 is thus determined by the zero setting arm 19.

When the pivot lever 16 is pivoted out of the normal position into the zero setting position, the fork-shaped end 25 of the zero setting arm 19 pivots the zero setting lever 22 into abutment against a stop 26. In this case, the setting surface 23 passes into the region of a heart-cam plate 27 which is arranged in a rotationally fixed manner on a seconds stem 28 parallel to the spindle 21.

By virtue of the action of the setting surface 23 on the radially peripheral lateral surface of the heart-cam plate 27, the heart-cam plate 27 is pivoted until the setting surface 23 reaches the location which is nearest the axis of rotation of the heart-cam plate 27 in the radial direction. As a result, however, the second hand 29, which is arranged on the seconds stem 28, is also moved into its zero position.

This pivoting of the seconds stem 28 can be carried without obstruction since a seconds-display drive mechanism 30 of the wheel train of the movement mechanism is mounted on the seconds stem 28 in a freely rotatable manner and is only coupled to the seconds stem 28 by a coupling spring 31 with a force fit. As a result, by virtue of the force fit of the coupling spring 31 being overcome, the seconds stem 28 can be rotated without being blocked by the seconds-display drive mechanism 30.

The coupling spring 31 is of leaf-spring design with a central part 33, from which there project three radially extending spring arms 34 which are angled out of the plane of the central part 33. The coupling spring 31 is arranged on the seconds stem 28 by way of a bore 35 formed in the central part 33. In this case, the central part 33 is supported on the heart-cam plate 27, while the free ends of the spring arms 34 are supported with prestressing on a radially directed, flange-like widened section 36 of the seconds-display drive mechanism 30. By virtue of the heart-cam plate 27 and seconds-display drive mechanism 30 being rotated relative to one another with sufficient force, it is possible to overcome the force-fit coupling between the central part 33 of the coupling spring 31 and the heart-cam plate 27 and the seconds-display drive mechanism 30.

At its free end, the stopping arm 20 of the pivot lever 16 has a pin 37 which projects transversely with respect to the pivot plane of said lever. This pin 37 interacts, counter to the force of a spring 40, with a stopping lever 39 which can be pivoted about a pivot spindle 38. One, free end of the stopping lever 39 is designed as a spring arm 41 and, by virtue of the stopping lever 39 being pivoted by the spring 40, can be moved into abutment against the radially peripheral contour of a balance wheel 42. The resilient abutment of the spring arm 41 against the balance wheel 42 means that the rotary movement of the latter can be stopped. In the normal position of the pivot lever 16, the pin 37 of the stopping arm 20 butts against a stop surface 43 of the stopping lever 39 and thus keeps the spring arm 41 of the stopping lever 39, counter to the force of the spring 40, at a distance from the balance wheel 42, with the result that the latter can move freely.

By virtue of the pivot lever 16 being pivoted into the zero setting position, the pin 37 of the stopping arm 20 is disengaged from the stopping lever 39, with the result that the spring 40 pivots the stopping lever 39 and the latter, by way of its spring arm 41, comes into abutment, with prestressing, against the radially peripheral contour of the balance wheel 42 and blocks the movement of the balance wheel 42. The movement mechanism of the timepiece is also put out of operation as a result.

A blocking lever 45 is arranged such that it can be pivoted about a pivot spindle 44 parallel to the spindle 21 of the zero setting lever 22.

By virtue of a blocking spring 46, the blocking lever 45 can be moved, by way of its free end, against the radially peripheral lateral surface of the flange-like widened section 36. At this free end, the blocking lever 45 has an approximately V-shaped blocking region 47 by means of which it can be pivoted into an approximately V-shaped groove 48, which is formed around the periphery, in the radial direction, of the radially peripheral lateral surface of the widened section 36.

In the normal position (FIG. 1), the pin 24 of the zero setting lever 22 keeps the blocking region 47 of the blocking lever 45 disengaged from the groove 48 counter to the force of the blocking spring 46.

If the zero setting lever 22 is pivoted, by the pivot lever 16, out of the normal position into the zero setting position, then the blocking lever 45, which is supported on the pin 24, follows until it engages in the groove 48 by way of its blocking region 47 and thus blocks the seconds-display drive mechanism 30.

The zero setting lever 22 is then moved on further by the pivot lever 16 until it comes to rest, by way of its setting surface 23, on the heart-cam plate 27 and rotates the latter until the setting surface 23 butts against the radially lowest point of the heart-cam plate 27 and the second hand 29 is thus located in its zero position.

In this case, the seconds-display drive mechanism 30 is blocked before the heart-cam plate 27 is adjusted.

For the purpose of setting the timepiece to the right time, first of all the setting stem 1 is drawn upward, by means of a winder (not illustrated), out of the normal position, which is illustrated in FIG. 1, into the setting position, which is illustrated in FIG. 2.

As a result, the angle lever 4 is pivoted in the counter-clockwise direction and transmits its movement to the control plate 12. Until the intermediate position, which is illustrated in FIG. 3 has been reached, the angle between the control curve 14 and the activation surface 15 is such that there is self-locking between the two abutting parts. As the control curve 14 is pivoted further, the pivot lever 16 is also pivoted, with the result that the angle between the control curve 14 and activation surface 15 changes such that self-locking of these two abutting parts is now ruled out. Under the force of the spring arm 18, the pivot lever 16 then automatically slides along the control curve 14 by way of its activation surface 15 and, in the process, pivots such that it moves over the pin 24 of the zero setting lever 22 by way of its fork-shaped end 25 and releases the blocking lever 45, with the result that the latter follows the zero setting lever 22 under the action of the blocking spring 46.

As a result, first of all the seconds-display drive mechanism is blocked. Then the zero setting lever 22 acts on the heart-cam plate 27 by way of its setting surface 23 and, overcoming the frictional forces of the coupling spring 31, said heart-cam plate 27 is moved directly into the zero position and is secured there.

At the same time, the stopping lever 39 is pivoted, by way of its spring arm 41, against the balance wheel 42 by the stopping arm 20 of the pivot lever 16 and stops said balance wheel.

Then, by virtue of rotation of the setting stem 1, a minute hand (not illustrated) and an hour hand (not illustrated either) are set to the correct time, e.g. of the next time signal.

When this time signal sounds, then the setting stem 1 is displaced into the normal position again, as a result of which the angle lever 4 and, following passage through a certain free path of the angle lever 4, via the control plate 12, the pivot lever 16 and the zero setting lever 22, by way of its setting surface 23, are forced back into their normal positions, as a result of which the heart-cam plate 27 is released.

The pin 24 then lifts the blocking lever 45, with the result that the blocking region 47 of the latter is moved out of the groove 48 and the seconds-display drive mechanism 30 is released.

At the same time, the stopping arm 20 acts on the stop surface 43 of the stopping lever 39, lifts off the spring arm 41 of the latter from the balance wheel 42 and releases said balance wheel.

As a result, the movement mechanism of the timepiece runs freely and the hands move synchronously.

For the purpose of adjusting the lever paths, use is made of an eccentric 50 on the pivot spindle 17 for the pivot lever 16, of an eccentric 51 on the stop 26 of the zero setting lever 22, and of an eccentric 52 on the pivot spindle 44 of the blocking lever 45.

Of course, the seconds-display drive mechanism which is to be blocked need not necessarily be the drive mechanism which is seated on the seconds stem; rather, it is also possible for it to be a gear wheel which is in the vicinity of said drive mechanism and is located in the wheel train which leads to said drive mechanism. However, it is best if it is the drive mechanism which is seated on the seconds stem which is blocked.

What is claimed is:

1. An arrangement for setting a minute hand of a timepiece which has at least minute and second hands, comprising a movment mechanism, a setting stem which is movable axially out of a normal position into a setting position, a zero setting drive of the second hand, a seconds-display drive mechanism of the movement mechanism of the timepiece, wherein upon movement of the setting stem out of the normal position into the setting position, said zero setting drive of the second hand is drivable such that the latter is moved thereby into a zero position thereof, and a seconds stem bears the second hand, said seconds stem is drivable via said seconds-display drive mechanism of the movement mechanism of the timepiece, wherein the seconds-display drive mechanism (30) has a blocking device, said blocking device is actuatable by the setting stem (1) being moved in direction of the setting position, such that the seconds-display drive mechanism (30) is blocked before the second hand (29) is moved into the zero position.

2. The arrangement as claimed in claim 1, wherein the setting stem (1) is a minute setting stem of the timepiece and the setting position is the minute setting position, in which, by rotation of the setting stem (1), the minute hand is drivable such that it is movable manually.

3. The arrangement as claimed in claim 1, wherein the seconds stem (28) is coupled to the movement mechanism of the timepiece by action of force.

4. The arrangement as claimed in claim 3, further comprising a prestressed coupling spring (31), and wherein arranged between the seconds stem (28) and said seconds-display drive mechanism (30) of the movement mechanism is said prestressed coupling spring (31) which abuts against at least either the seconds stem (28) or the seconds-display drive mechanism (30) with a friction fit.

5. The arrangement as claimed in claim 4, wherein the seconds-display drive mechanism (30) is freely rotatably mounted on the seconds stem (28).

6. The arrangement as claimed in claim 5, wherein the coupling spring (31) is arranged axially between the seconds stem (28) and said seconds-display drive mechanism (30).

7. The arrangement as claimed in claim 6, wherein the coupling spring (31) is a spring which has at least one radially directed spring arms, of said siring arms one spring-arm end is arranged on the seconds stem (28) and a second spring-arm end is supported on an end side of seconds-display drive mechanism (30).

8. The arrangement as claimed in claim 7, further comprising a radially directed flange-like widened section (36) of the seconds-display drive mechanism (30) wherein the second spring-arm end is supported on said radially directed flange-like widened section (36) of the seconds-display drive mechanism (30).

9. The arrangement as claimed in claim 1, further comprising a pivot spindle (44), and a moveable drive part of the seconds-display drive mechanism (30), wherein the blocking device has a blocking lever (45) which is pivotable about said pivot spindle (44) and which is actable on said moveable drive part of the seconds-display drive mechanism (30).

10. The arrangement as claimed in claim 9, further comprising a flange-like widened section (36) of the seconds-display mechanism (30), wherein the moveable drive part is the flange-like widened section (36) of the seconds-indicating drive mechanism (30), the blocking lever (45) being actable on a radially peripheral lateral surface thereof.

11. The arrangement as claimed in claim 10, further comprising a gear wheel, and wherein the radially peripheral lateral surface has a radially peripheral, approximately V-shaped groove (48) into which the blocking lever (45), which is pivotable about the pivot spindle (44), parallel to an axis of rotation of the gear wheel, is pivotable by an approximately V-shaped blocking region (47).

12. The arrangement as claimed in claim 1, further comprising a zero setting lever (22), wherein the zero setting drive is a cam-plate drive, a cam plate of the cam-plate drive is arranged fixedly on the seconds stem (28), and, upon movement of the setting stem (1) in the direction of the setting position, is drivable such that it is movable into the zero position by said zero setting lever (22).

13. The arrangement as claimed in claim 12, wherein said cam-plate drive is a heart-cam zero setting drive.

14. The arrangement as claimed in claim 13, further comprising a spindle (21), wherein the zero setting lever (22) is a lever which about said spindle (21) parallel to the seconds stem (28) and which acts on a radially peripheral lateral surface of the cam plate.

15. The arrangement as claimed in claim 12, further comprising a pivot spindle (17), wherein the zero setting drive has a pivot lever (16) which is pivotable about said pivot spindle (17) parallel to the seconds stem (28), between a normal position and a zero setting position, which is forced into said zero setting position thereof by spring action and which is actable on the zero setting lever (22) such that it is movable out of its normal position, in which it is spaced apart from the cam plate, against the cam plate.

16. The arrangement as claimed in claim 9, wherein the blocking lever (45) is drivable such that it is pivotable by the pivot lever (16).

17. The arrangement as claimed in claim 9, further comprising a zero setting lever (22) and a spindle (21), wherein the zero setting lever (22) is pivotal about said spindle (21), and wherein the pivot spindle (44) of the blocking lever (45) and the spindle (21) of the zero setting lever (22) are arranged axially with respect to one another, and a blocking engagement direction of the blocking lever (45) and a zero setting direction of the zero setting lever (22) are oriented approximately the same.

18. The arrangement as claimed in claim 17, further comprising a blocking spring (46), and wherein the zero setting drive has a pivot lever (16), wherein action of said blocking spring (46) forces the blocking lever (45) both in the blocking engagement direction and against the pivot lever (16), such that the latter is forced into a zero setting position.

19. The arrangement as claimed in claim 18, wherein said pivot lever (16) or said zero setting lever (22) has a stop, wherein action of the blocking spring (46) forces the blocking lever (45) into abutment against said stop of the pivot lever (16) or of the zero setting lever (22), wherein, when the blocking lever (45) and pivot lever (16) are respectively pivoted in the blocking engagement direction and the zero setting direction, the blocking lever (45) reaches blocking position before the zero setting lever (22) reaches the zero setting position.

20. The arrangement as claimed in claim 1, further comprising a pivot spindle (44) and a moveable drive part of the seconds-display drive mechanism (30), wherein the blocking device has a blocking lever (45) which is pivotable about said pivot spindle (44) and which is actable on said moveable drive part of the seconds-display drive mechanism (30) with a force, form of cooperating parts or friction fit.

* * * * *